US006432152B2

(12) United States Patent
Frerich

(10) Patent No.: US 6,432,152 B2
(45) Date of Patent: Aug. 13, 2002

(54) CLEANING ARRANGEMENT OF A SIEVE

(75) Inventor: Josef Frerich, Zweibrücken (DE)

(73) Assignee: Deere & Company, Moline, IL (US)

( * ) Notice: Subject to any disclaimer, the term of this patent is extended or adjusted under 35 U.S.C. 154(b) by 2 days.

(21) Appl. No.: 09/757,976

(22) Filed: Jan. 10, 2001

(30) Foreign Application Priority Data

Mar. 16, 2000 (DE) ..... 100 12 766

(51) Int. Cl.[7] ..... B01D 46/00

(52) U.S. Cl. ..... 55/295; 55/297; 55/385.3; 55/467

(58) Field of Search ..... 55/282.2, 289, 55/290, 291, 295, 296, 297, 385.3, 400, 467

(56) References Cited

U.S. PATENT DOCUMENTS

| | | | | | |
|---|---|---|---|---|---|
| 2,152,760 | A | * | 4/1939 | Gromley | 55/289 |
| 3,155,473 | A | * | 11/1964 | McNeil | 55/294 |
| 3,478,623 | A | * | 11/1969 | Easter | 475/165 |
| 3,837,149 | A | * | 9/1974 | West et al. | 55/290 |
| 4,443,236 | A | * | 4/1984 | Peiler et al. | 55/385.3 |
| 5,183,487 | A | * | 2/1993 | Lodico et al. | 55/289 |
| 5,569,315 | A | * | 10/1996 | K onig et al. | 55/289 |
| 5,735,337 | A | * | 4/1998 | Edwards | 55/385.3 |
| 6,248,145 | B1 | * | 6/2001 | Radke | 55/295 |

FOREIGN PATENT DOCUMENTS

| | | | | |
|---|---|---|---|---|
| DE | 453 597 | * | 12/1927 | |
| DE | 453 597 | | 12/1997 | |
| EP | 0 313 763 A1 | * | 5/1989 | F01P/11/12 |
| EP | 0 489 975 A1 | | 6/1992 | |
| EP | 0 985 439 A1 | | 3/2000 | |

* cited by examiner

*Primary Examiner*—Duane Smith
*Assistant Examiner*—Jason M. Greene

(57) ABSTRACT

An arrangement for cooling the engine of a harvesting vehicle includes a circular sieve or screen mounted for rotation about a fore-and-aft axis and through which air is drawn by a fan which discharges the air through a cooling device. A cleaner in the form of a brush includes a cylindrical bristle arrangement mounted for rotating about an axis arranged parallel to an inlet side of the sieve with the bristles projecting through sieve openings. Located on the outlet side of the sieve is a suction device that acts to carry away contaminants poked through the sieve by the bristles of the brush. A further embodiment of the invention includes a second suction device mounted adjacent the inlet side of the sieve in trailing relationship to the brush arrangement so as to be able to carry away contaminants loosened by the brush arrangement but still clinging to the inlet side of the sieve.

6 Claims, 2 Drawing Sheets

CLEANING ARRANGEMENT OF A SIEVE

The present invention concerns a cleaning arrangement of a sieve or screen provided with openings through which air flows, with a brush arranged on the air inlet side of and having bristles penetrating openings of the sieve.

BACKGROUND OF THE INVENTION

EP 489975 A discloses a sieve arrangement having a perforated filter element and a cleaning brush arranged on the air outlet side of the sieve. Contaminants accumulating in the perforated sieve are punched out of the perforations by the bristles of the brush and are blown away and removed by a blower arrangement located under the sieve. The brush punches out the contaminants against the air flow passing through the sieve, so that the resulting disadvantage is that the contaminants are not efficiently sucked away by the blower but, due to the air flow, are often pushed again into the sieve by the air flow.

A similar sieve arrangement is disclosed in EP 0 985 439 A and includes a rotating sieve, with rotating brushes being mounted at its outlet side and having bristles that penetrate its air inlet openings. The brushes are located in the operating region of a suction device arranged on the air inlet side of the sieve. Here, too, the suction device must operate against the direction of the air flow, so that relatively high suction power is required.

Another cleaning device for a sieve is disclosed in DE 453 597 A and includes roll-shaped brushes arranged on the inlet side of the sieve. Opposite the brushes on the outlet side, an unbroken plate with sector-shaped cutouts is arranged. This should result in the contaminants, that are pushed out of the sieve by the brushes, falling downward as a result of the air flow interruption caused by the plate. Here it is considered a disadvantage that the contaminants that fall downward can reach the air flow below the plate, so that the filtration effect achieved is inadequate.

SUMMARY OF THE INVENTION

According to the present invention, there is provided an improved cleaning arrangement for a sieve.

An object of the invention is to provide an improved sieve cleaning arrangement including a brush arrangement at the inlet side of the sieve, as determined relative to a stream of air flowing through openings, which operates to poke contaminants through the sieve, and to provide a suction device on the outlet side of the sieve for removing the contaminants that have been poked through.

A more specific object of the invention is to provide a sieve together with a brush arrangement and a suction device, as set forth in the previous object, wherein the sieve is flat and circular and is mounted for rotation about a first axis while the suction device is fixed.

Yet another specific object is to provide a cooling device as set forth in the immediately preceding object which includes a second suction device mounted at the inlet side of the sieve for removing contaminants loosened by the brush arrangement.

These and other objects of the invention will become apparent from a reading of the ensuing description together with the appended drawings.

DESCRIPTION OF THE PREFERRED EMBODIMENT

Figure 1:
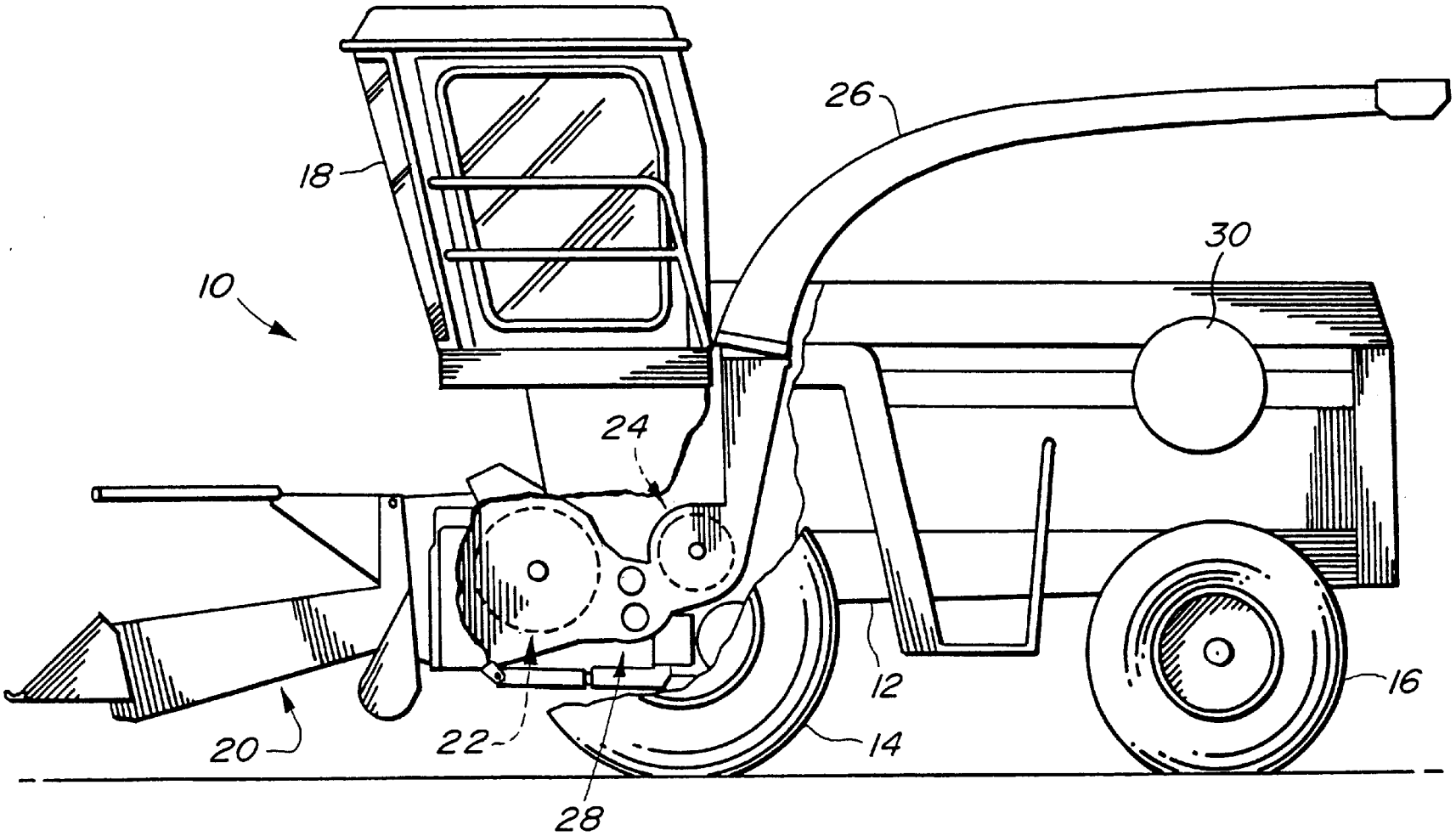
FIG. 1 is a schematic left side elevational view of a harvesting machine of the type with which the present invention is particularly adapted for use.

A harvesting machine 10, as shown in FIG. 1, is in the form of a self-propelled forage harvester including a chassis 12 that is carried by front and rear sets of wheels 14 and 16, respectively. The harvesting machine 10 is controlled from an operator's cab 18 from which a crop intake arrangement 20 can be viewed during operation. Crop, for example, corn, grass or the like, taken up from the ground by the crop intake arrangement 20 is conducted to a chopper drum 22 that chops it into small pieces and delivers it to a conveyor arrangement 24. The crop leaves the harvesting machine 10 to an accompanying trailer through a discharge duct 26 mounted for rotating about an upright axis. Between the chopper drum 22 and the conveyor arrangement 24, a post-chopper reducing arrangement 28 extends through which crop to be conveyed is conducted tangentially to the conveyor arrangement 24.

Figure 2:
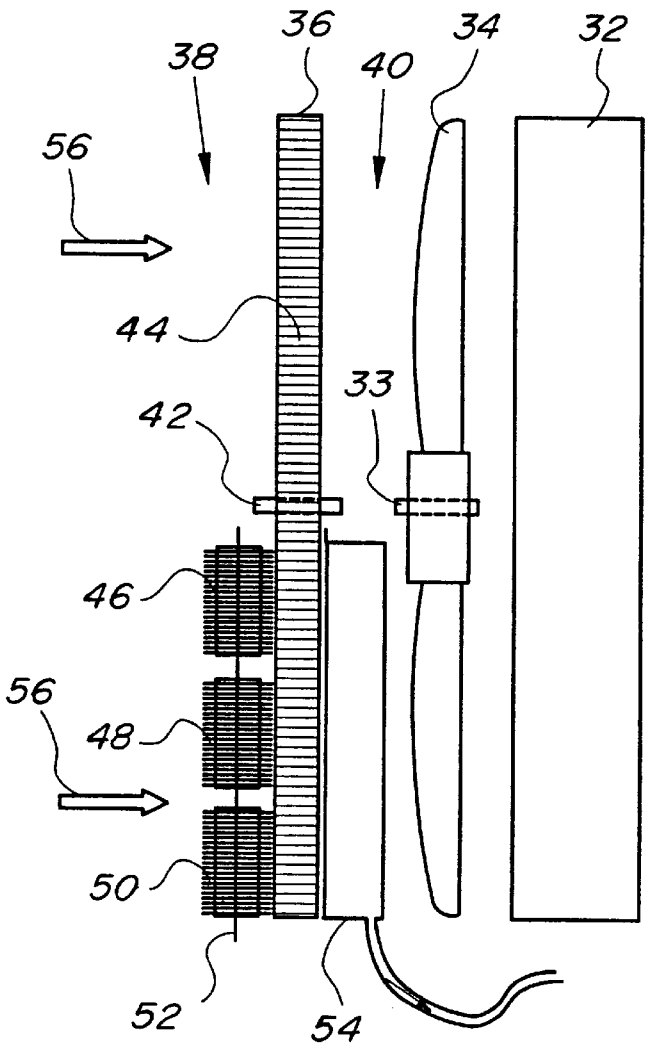
FIG. 2 is a schematic side view of the cooling arrangement of the harvesting machine with a cleaning arrangement of the sieve according to the invention.

A suction intake opening 30 is provided on the side wall of the harvesting machine 10 above the rear wheel 16. Referring now also to FIG. 2 there is shown an axis 33 rotatably supporting a propeller-shaped fan 34 that sucks cooling air through the opening 30 for cooling the drive engine and other components of the harvesting machine. The air taken in flows in the direction of the arrows 56 through a circular sieve 36 mounted for rotation about an axis 42 that is aligned with the fan axis 33. Air then flows through openings 44 of the sieve 36 and then reaches a cooler 32 arranged downstream of the fan 34. The cooler 32 is connected through cooling fluid lines, not shown, with the drive engine of the harvesting machine 10 and/or other components. The air heated by the cooler 32 is then returned to the atmosphere through appropriate openings. It is conceivable that the fan 34 be arranged downstream of the cooler 32 so that the air coming from the sieve 36 flows through the cooler 32, then reaches the fan 34, where it can be conducted along the engine and then leaves the harvesting machine 10.

The task of the sieve 36 is to keep undesired contaminants, that can be produced in large quantities during harvesting operations, away from the cooler 32. Therefore, the sieve 36 is equipped with relatively small openings 44 that keep the largest contaminants away. It is also conceivable that the axes 42 and 33 be arranged offset from each other rather than coaxial. But, as a rule, they then would extend generally parallel to each other.

In order to prevent the sieve 36 from becoming blocked by contaminants during the harvesting operation (blocking especially being a problem during humid atmospheric conditions), that can have the result that the engine becomes overheated due to the reduced cooling air flow, a cleaning arrangement is provided that incorporates three brushes 46, 48 and 50 arranged one above the other that can rotate independently of each other about a common axis 52. The axis 52 extends radially of the sieve 36. The brushes 46, 48 and 50 are arranged on the air inlet side 38 of the sieve 36 and are provided with bristles that penetrate the openings 44 of the sieve 36. In this way, contaminants are punched through the openings 44. A suction device 54 is arranged on the air outlet side 40 of the sieve 36. The brushes 46, 58 and

50 are located in the operating region of the suction device 54, so that the latter takes up and removes the contaminants punched through the openings 44 by the brushes 46, 48 and 50. The suction device 54 can be connected in a manner known in itself to an exhaust gas ejector—or to any desired other arrangement so as to generate a negative pressure that is lower than that existing at the location of the suction device 54. The brushes 46, 48 and 50 are rotated by the friction against the sieve 36 about the axis 52, so that no separate drive is required. The suction device 54 is provided with a suction intake opening that extends over the entire height of the brushes 46, 48 and 50.

Figure 3:
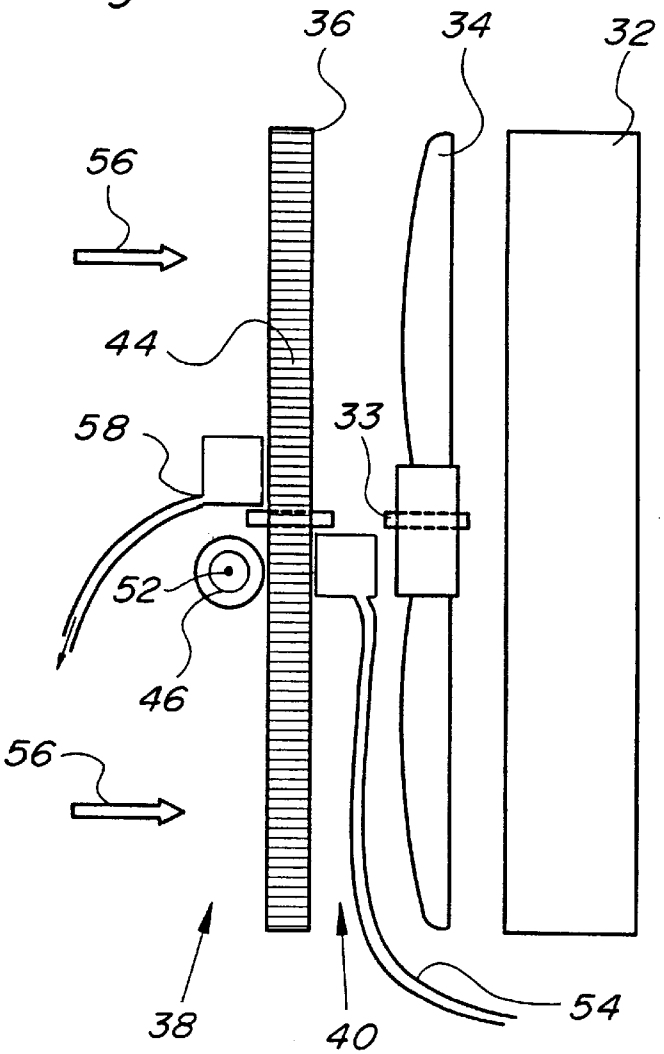
FIG. 3 is a plan view of the cooling arrangement of FIG. 2.

Referring now to FIG. 3, it can be seen that a second suction device 58 is arranged to the side alongside the brushes 46, 48 and 50 on the inlet side of the sieve 36. The second suction device 58 is connected, as is the suction device 54, with an arrangement for generating negative pressure. The second suction device 58 is also equipped with a suction inlet opening that extends over the entire height of the brushes 46, 48 and 50. The second suction device 58 sucks the contaminants removed and/or loosened from the inlet side surface of the sieve 36 by the brushes 46, 48 and 50. In particular, the second suction device 58 can suck the contaminants from the brushes 46, 48 and 50 and/or directly from the surface of the sieve 36. The direction of rotation of the sieve 36 is such that its surface is first conducted past the brushes 46, 48 and 50 and immediately thereafter past the second cleaning arrangement 58.

What is claimed is:

1. In a combination including a sieve defining a plurality of holes extending between upstream and downstream sides of said sieve, relative to an intended direction of a stream of air flowing through said sieve, and a cleaning arrangement for cleaning contaminants strained out from said air flow by said sieve, the improvement comprising: said cleaning arrangement including a brush located on said upstream side of said sieve and having bristles penetrating openings of said sieve that are adjacent said brush; a suction device having an inlet sized commensurate with a projection normal to said sieve of a periphery of said brush and located closely adjacent said downstream side of said sieve so as to be directly opposite said brush; and one of said sieve, or brush and suction device being movable relative to the other so that said bristles penetrate a majority of said openings during one complete cycle of relative movement between said sieve, and said brush and said suction device.

2. The combination defined in claim 1 wherein said sieve is mounted for rotation about a fixed axis and said suction device and brush are mounted at fixed locations such that said upstream side moves past said brush and said downstream side moves past said inlet of said suction device during rotation of said sieve.

3. The combination defined in claim 2 wherein said sieve is circular and said downstream and upstream sides are planar; said brush being circular in end view and mounted for rotation about an axle having a length substantially equal to that of a radius of said sieve and being mounted at one side of said fixed axis for rotation about a second axis extending parallel to said upstream side of said sieve, whereby rotation of said sieve will, through contact with said bristles, cause said brush to rotate.

4. The combination defined in claim 3 wherein said brush is constructed in multiple, axially aligned segments, with each segment being individually mounted for rotation about said second axis.

5. The combination defined in claim 3 and further including a second suction device, having a length commensurate with that of said brush, having an inlet located adjacent said sieve on said inlet side of said sieve, and extending in parallel, trailing relationship to said brush, relative to a direction of rotation of said sieve, whereby said sieve will first sweep past said brush and then past said inlet of said second suction device.

6. The combination defined in claim 1 and further including a fan and cooling device located in series on said downstairs side of said sieve, with said fan being operative to cause said stream of air.

* * * * *

UNITED STATES PATENT AND TRADEMARK OFFICE

CERTIFICATE OF CORRECTION

PATENT NO. : 6,432,152 B2
DATED : August 13, 2003
INVENTOR(S) : Josef Frerich

It is certified that error appears in the above-identified patent and that said Letters Patent is hereby corrected as shown below:

Column 4,
Line 37, “downstairs” should be replaced with -- downstream --.

Signed and Sealed this

Sixth Day of January, 2004

JAMES E. ROGAN
*Director of the United States Patent and Trademark Office*